US008044609B2

(12) United States Patent
Liu

(10) Patent No.: US 8,044,609 B2
(45) Date of Patent: Oct. 25, 2011

(54) CIRCUITS AND METHODS FOR CONTROLLING LCD BACKLIGHTS

(75) Inventor: Da Liu, Milpitas, CA (US)

(73) Assignee: 02Micro Inc, Santa Clara, CA (US)

( * ) Notice: Subject to any disclaimer, the term of this patent is extended or adjusted under 35 U.S.C. 154(b) by 240 days.

(21) Appl. No.: 12/317,977

(22) Filed: Dec. 31, 2008

(65) Prior Publication Data

US 2010/0164403 A1 Jul. 1, 2010

(51) Int. Cl.
*H05B 37/02* (2006.01)
*H05B 39/00* (2006.01)

(52) U.S. Cl. ..... 315/291; 315/312

(58) Field of Classification Search ..... 315/291, 315/307, 224, 244, 312
See application file for complete search history.

(56) References Cited

U.S. PATENT DOCUMENTS 6,369,525 B1 * 4/2002 Chang et al. ..... 315/300
6,847,169 B2 * 1/2005 Ito et al. ..... 315/77
7,116,086 B2 * 10/2006 Burgyan et al. ..... 323/271
7,408,308 B2 * 8/2008 Sawada et al. ..... 315/291
7,710,049 B2 5/2010 Wang et al.
7,804,256 B2 * 9/2010 Melanson ..... 315/291
2008/0088346 A1 * 4/2008 Coleman ..... 327/103
2008/0116818 A1 * 5/2008 Shteynberg et al. ..... 315/192
2008/0203946 A1 * 8/2008 Ito et al. ..... 315/307
2009/0322234 A1 * 12/2009 Chen et al. ..... 315/159

FOREIGN PATENT DOCUMENTS

CN 101155449 A 4/2008
CN 101222805 A 7/2008
EP 1922712 A2 5/2008
WO 2007021935 A2 2/2007

* cited by examiner

*Primary Examiner* — Douglas W Owens
*Assistant Examiner* — Minh D A

(57) ABSTRACT

A circuit for controlling light sources comprises a converter, a feedback circuit and a current distribution controller. The converter is operable for converting an input voltage to an output current and for providing the output current to the light sources. The feedback circuit is coupled to the light sources for generating feedback signals indicative of currents flowing through the light sources respectively. The current distribution controller is coupled to the feedback circuit for generating control signals based on the feedback signals respectively so as to regulate the currents of the light sources respectively, and for controlling the converter to regulate the output current based on the feedback signals.

19 Claims, 8 Drawing Sheets

CIRCUITS AND METHODS FOR CONTROLLING LCD BACKLIGHTS

BACKGROUND

Light-emitting diodes (LEDs) can be used for lighting systems with advantages of higher energy efficiency, longer life, smaller size, etc. To produce sufficient brightness, multiple LEDs coupled in series, in parallel or in serial-parallel combinations can be applied.

FIG. 1 shows a conventional LED circuit 100. The circuit 100 includes LED strings 102, 104 and 106, a direct current (DC) power supply 160, a DC/DC converter 110, a selection circuit 120, and linear regulators 122, 124 and 126. Each of the LED strings 102, 104 and 106 includes serially coupled LEDs.

The DC/DC converter 110 converts a DC voltage VDC from the DC power supply 160 to an output voltage VOUT for driving LEDs. Due to variation in LED manufacturing, currents flowing through the LED strings 102, 104 and 106 may not be identical. The linear regulators 122, 124 and 126 are used to regulate the currents flowing through the LED strings 102, 104 and 106 in a linear mode, respectively. The linear regulators 122, 124 and 126 also send feedback signals indicative of forward voltage drops of the LED strings 102, 104 and 106 to the selection circuit 120, respectively. The selection circuit 120 can select a feedback signal having a maximum level (maximum feedback signal) from the feedback signals. The maximum feedback signal can be used by the DC/DC converter 110 to regulate the output voltage to a level no less than the maximum forward voltage drop of the LED strings 102, 104 and 106.

However, due to the power dissipation in the linear regulators 122, 124 and 126, the circuit 100 may have relatively low power efficiency.

FIG. 2 shows a conventional circuit 200. The circuit 200 includes a DC power supply 260, a DC/DC converter 210, LED strings 202, 204 and 206, switching regulators 222, 224 and 226, diodes 262, 264 and 266, inductors 272, 274 and 276, and switching controller 232, 234 and 236. The switching regulators 222, 224 and 226 can be used to regulate and balance currents flowing through the LED strings 202, 204 and 206 in a switching mode, respectively. The switching controllers 232, 234 and 236 respectively control the switching regulators 222, 224 and 226 to operate in the switching mode. The diode 262 and the inductor 272 are used for averaging the current flowing through the LED string 202. Similarly, the diode 264 and the inductor 274 are used for averaging the current flowing through the LED string 204; the diode 266 and the inductor 276 are used for averaging the current flowing through the LED string 206.

However, multiple switching controllers and switching regulators in FIG. 2 may lead to a relatively high circuit cost and a relatively complex circuit structure.

SUMMARY

In one embodiment, a circuit for controlling light sources comprises a converter, a feedback circuit and a current distribution controller. The converter is operable for converting an input voltage to an output current and for providing the output current to the light sources. The feedback circuit is coupled to the light sources for generating feedback signals indicative of currents flowing through the light sources respectively. The current distribution controller is coupled to the feedback circuit for generating control signals based on the feedback signals respectively so as to regulate the currents of the light sources respectively, and for controlling the converter to regulate the output current based on the feedback signals.

BRIEF DESCRIPTION OF THE DRAWINGS

Features and advantages of embodiments of the invention will become apparent as the following detailed description proceeds, and upon reference to the drawings, where like numerals depict like elements, and in which.

DETAILED DESCRIPTION

Reference will now be made in detail to the embodiments of the present invention. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims.

Some portions of the detailed descriptions which follow are presented in terms of procedures, logic blocks, processing and other symbolic representations of operations on data bits within a computer memory. These descriptions and representations are the means used by those skilled in the data processing arts to most effectively convey the substance of their work to others skilled in the art. In the present application, a procedure, logic block, process, or the like, is conceived to be a self-consistent sequence of steps or instructions leading to a desired result. The steps are those requiring physical manipulations of physical quantities. Usually, although not necessarily, these quantities take the form of electrical or magnetic signals capable of being stored, transferred, combined, compared, and otherwise manipulated in a computer system.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present application, discussions utilizing the terms such as "generating," "providing," "selecting" or the like, refer to the actions and processes of a computer system, or similar electronic computing device, that manipulates and transforms data represented, as physical (electronic) quantities within the computer system's registers and memories into other data similarly represented as physical quantities within the computer system memories or registers or other such information storage, transmission or display devices.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

Embodiments according to the invention are discussed in the context of light-emitting diodes (LEDs); however, the invention is not so limited. The invention can be well-suited for various types of light sources and loads.

Figure 1:
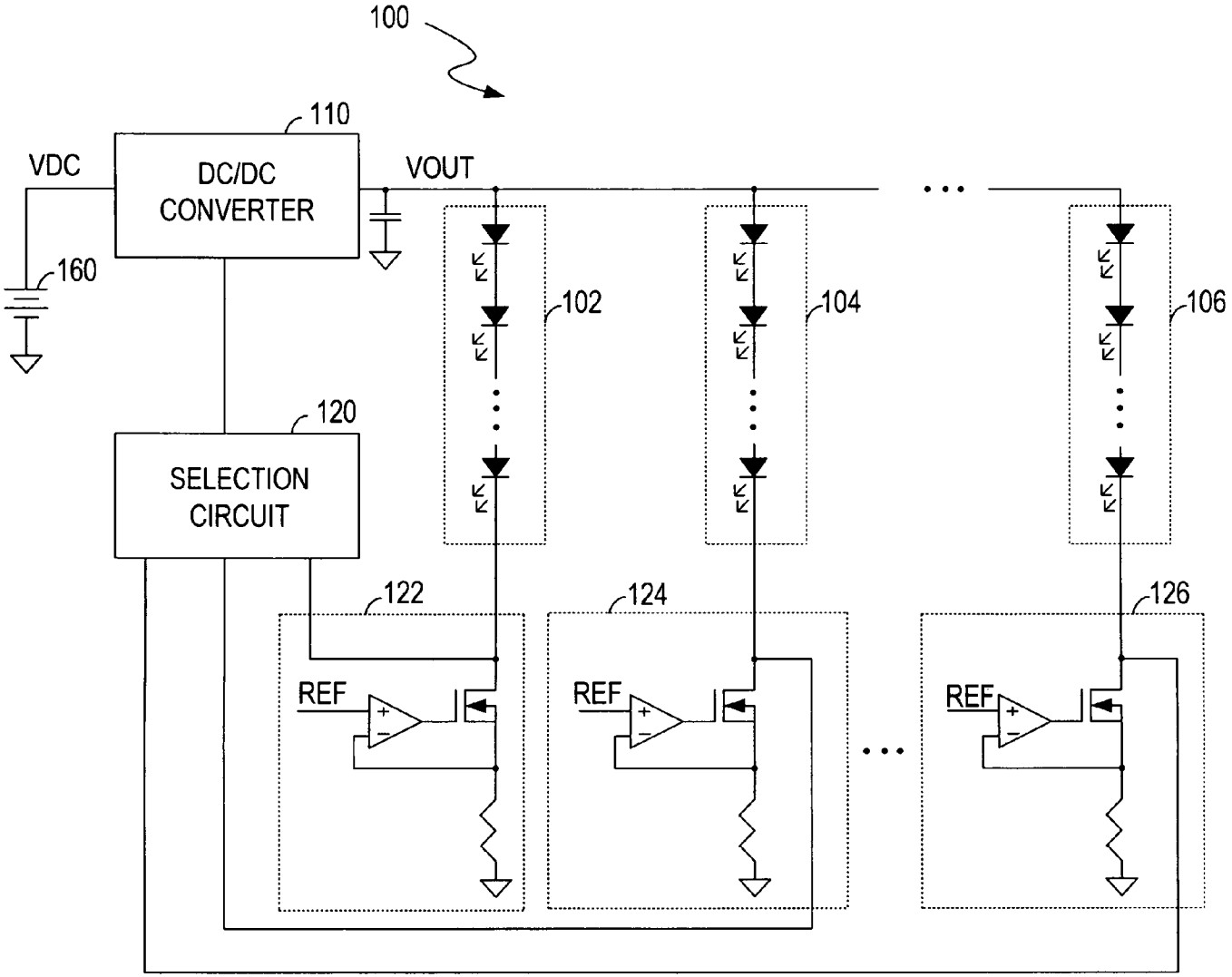
FIG. 1 PRIOR ART
FIG. 1 shows a block diagram of a conventional circuit for controlling and powering LEDs.
Figure 2:
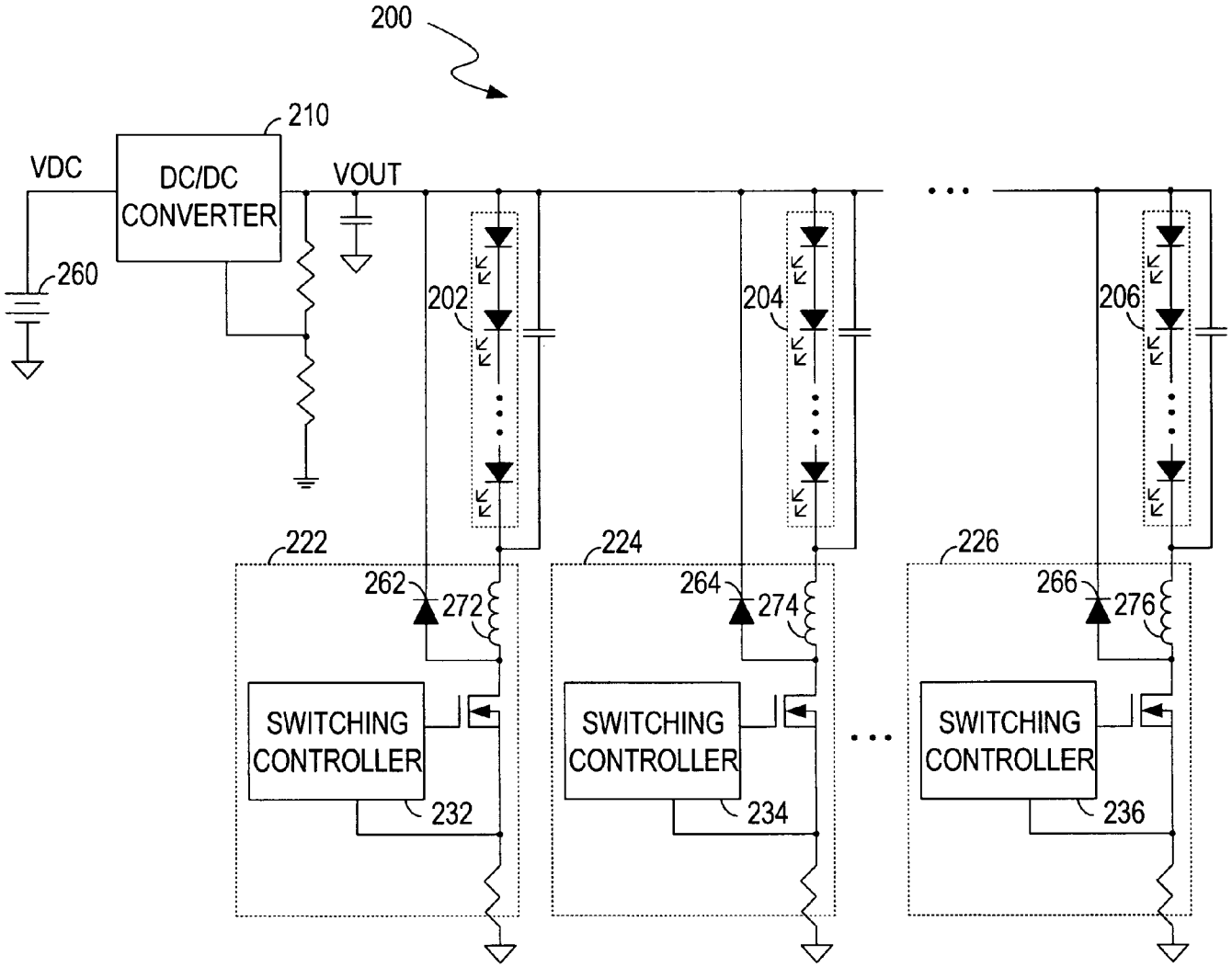
FIG. 2 PRIOR ART
FIG. 2 shows a block diagram of another conventional circuit for controlling and powering LEDs.
Figure 3:
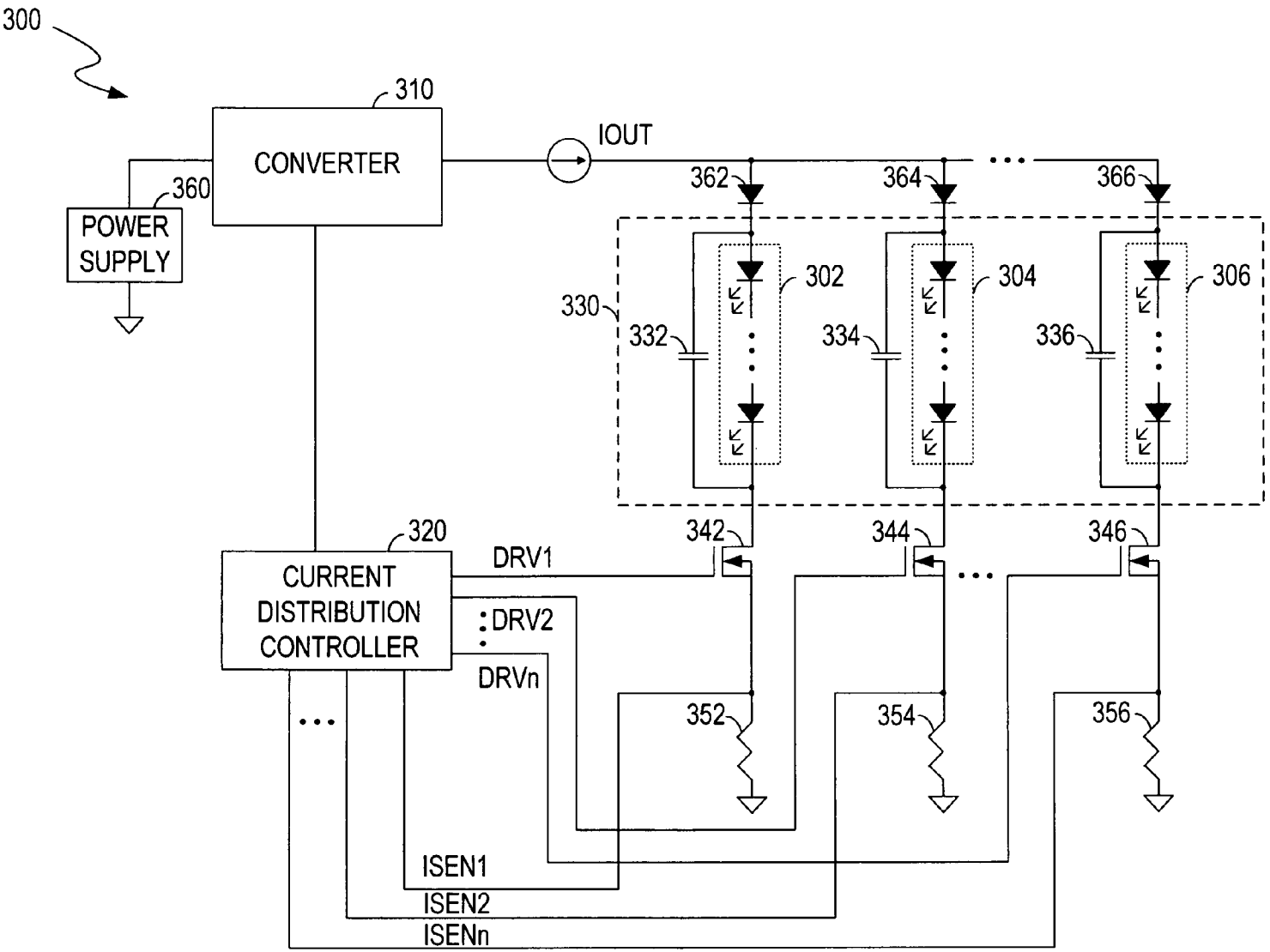
FIG. 3 shows a block diagram of a circuit 300 for controlling and powering light sources, in accordance with one embodiment of the present invention.

FIG. 3 illustrates a block diagram of a circuit 300 for controlling and powering light sources, e.g., LEDs, in accordance with one embodiment of the present invention. In the example of FIG. 3, the circuit 300 includes a power supply 360, a converter 310, a current distribution controller 320, and a load, e.g., an LED array 330. The LED array 330 can form part of LED backlights in a liquid crystal display (LCD) panel, in one embodiment. The LED array 330 can include any number of LED strings coupled in parallel, such as three LED strings 302, 304 and 306 as shown in the example of FIG. 3. In order to avoid backward current, the LED strings 302, 304 and 306 can be separated from each other by three diodes 362, 364 and 366. Each of the LED strings 302, 304 and 306 can include any number of serially coupled LEDs.

The converter 310 can be coupled to the power supply 360 for converting an input voltage from the power supply 360 to an output current IOUT. The converter 310 can be, but is not limited to, a DC/DC converter or an alternating current to direct current (AC/DC) converter to accommodate various types of power supplies. The output current IOUT is supplied to the LED array 330. As such, the converter 310 serves as a current source for supplying the output current IOUT to the LED array 330, in one embodiment. Furthermore, the converter 310 can regulate the output current IOUT for satisfying the current requirement of the LED array 330, in one embodiment. The current distribution controller 320 can also be coupled to the LED array 330 for regulating LED currents flowing through the LED strings 302, 304 and 306 respectively.

The circuit 300 can include a feedback circuit for generating a plurality of feedback signals ISEN1-ISENn indicative of the currents flowing though the LED strings 302, 304 and 306 respectively. In the example of FIG. 3, the feedback circuit includes a plurality of sensors, e.g., sense resistors 352, 354 and 356. The current distribution controller 320 coupled to the feedback circuit can generate control signals DRV1-DRVn based on the feedback signals ISEN1-ISENn respectively so as to regulate LED currents flowing through the LED strings 302, 304 and 306 respectively. The current distribution controller 320 can also control the converter 310 to regulate the output current IOUT based on the feedback signals ISEN1-ISENn.

The circuit 300 can further include capacitors 332, 334 and 336, switches 342, 344 and 346. In one embodiment, the switches can be transistors as shown in the example of FIG. 3.

Taking the LED string 302 as an example, the capacitor 332 is used as the average current filter capacitor to average the current flowing through the LED string 302. The sense resistor 352 can generate a feedback signal ISEN1 indicative of the LED current flowing through the LED string 302. Based on the feedback signal ISEN1 from the sense resistor 352, the current distribution controller 320 can generate a control signal DRV1, e.g., a pulse width modulated (PWM) signal, to the switch 342. The current distribution controller 320 can adjust the duty cycle of the PWM signal DRV1 based on the sensed feedback signal ISEN1 and a predetermined reference signal to control the switch 342. In one embodiment, the switch 342 is controlled either on or off. As such, the current flowing through the LED string 302 is regulated in a switching mode. The LED currents flowing through the LED strings 304 and 306 can also be regulated by the current distribution controller 320 in a similar manner. Thus, based on the same predetermined reference signal, the LED currents flowing through the LED strings 302, 304 and 306 can be balanced. Furthermore, based on the sensed feedback signals ISEN1-ISENn, the converter 310 can be controlled by the current distribution controller 320 to regulate the output current IOUT for satisfying the current requirement of the LED array 330.

Advantageously, even when the forward voltages of the LED strings are different (when each LED string includes different number of LEDs), the currents flowing through the LED strings can still be controlled at a target level and can be balanced by controlling the duty ratio of the switches 342, 344, and 346.

Furthermore, since the converter 310 can convert the input voltage to the output current IOUT and can function as a current source for the LED array 330, the inductors which are used in the switching regulators from the conventional LED driving circuit can be eliminated. Therefore, the complexity and cost of the circuit can be reduced. In addition, the power efficiency of the circuit 300 can be enhanced compared to the conventional LED driving circuit using linear regulators.

Figure 4:
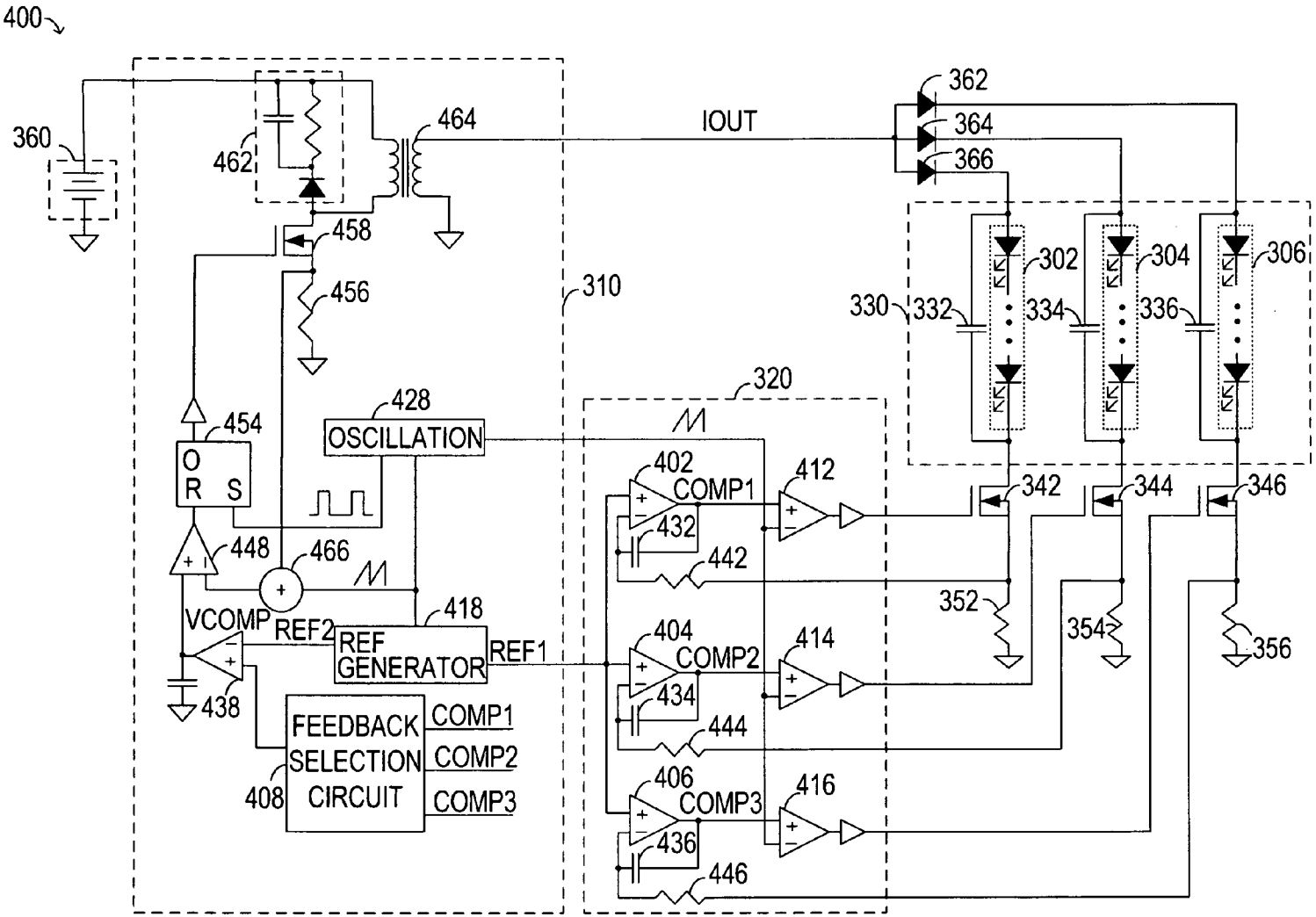
FIG. 4 shows a block diagram of a circuit 400 for controlling and powering light sources, in accordance with another embodiment of the present invention.

FIG. 4 shows a schematic diagram of a circuit 400 for controlling LEDs, according to one embodiment of the present invention. The circuit 400 is an example of the circuit 300. Elements labeled the same in FIG. 3 have similar functions. FIG. 4 is described in combination with FIG. 3. The circuit 400 provides a detailed schematic for the converter 310 and the current distribution controller 320.

In the example of FIG. 4, the current distribution controller 320 includes error amplifiers 402, 404 and 406, comparators 412, 414 and 416, capacitors 432, 434 and 436, and resistors 442, 444 and 446. The error amplifiers 402, 404 and 406 are coupled to the LED strings 302, 304 and 306 and can compare the feedback signals with a reference signal, e.g., REF1, and generate error signals COMP1, COMP2 and COMP3 respectively. Thus, the error signals COMP1, COMP2 and COMP3 are generated based on the sensed LED currents flowing through the LED strings 302, 304 and 306 and the reference signal REF1. In one embodiment, the reference signal REF1 can be a reference voltage indicative of a target current for each of the LED strings 302, 304 and 306, and can be provided by the converter 310. The comparators 412, 414 and 416 are coupled to the error amplifiers 402, 404 and 406 respectively and are operable for generating control signals, e.g., PWM signals, to control the switches 342, 344 and 346 respectively. More specifically, the comparators 412, 414 and 416 can compare the error signals COMP1, COMP2 and COMP3 with a saw-tooth signal respectively to generate the control signals.

Taking the current regulation for LED string 302 as an example, the sense resistor 352 can generate a feedback signal indicative of the LED current flowing through the LED string 302. The feedback signal is fed back to the input of the error amplifier 402 via the capacitor 432 and the resistor 442. The sensed feedback signal which can be a voltage pulse signal across the resistor 352 can be converted to a DC signal by the capacitor 432 and the resistor 442. The error amplifier 402 can compare the DC signal and the reference signal REF1 to generate the error signal COMP1. The error signal COMP1 increases if the DC signal is higher than the reference signal REF1, and decreases if the DC signal is lower than the reference signal REF1, in one embodiment. The comparator 412 can compare the error signal COMP1 with a saw-tooth signal to generate the PWM signal used for controlling the switch 342. In one embodiment, the saw-tooth signal can be provided by the converter 310. The duty cycle of the PWM signal which varies in accordance with the error signal COMP1 is used to control the switch 342 to be on and off, so as to regulate the LED current flowing through the LED string 302.

Similar to the error signal COMP1, error signals COMP2 and COMP3 are output by the error amplifiers 404 and 406 respectively for generating PWM signals. The currents in the LED strings 304 and 306 can also be regulated. As such, by using the common reference signal REF1, the LED currents in the LED strings 302, 304, and 306 can be balanced with each other by the current distribution controller 320.

The total current IOUT for the LED array 330 can be provided and regulated by the converter 310. The converter 310 includes a feedback selection circuit 408, a reference (REF) generator 418, an oscillator 428, a snubber circuit 462, a transformer 464, a switch 458, a resistor 456, a RS flip-flop 454, a current adder 466, a comparator 448 and an error amplifier 438, in one embodiment.

The feedback selection circuit 408 can be coupled to the error amplifiers 402, 404 and 406 for selecting an error signal having a maximum level among the error signals COMP1, COMP2 and COMP3, in one embodiment. The REF generator 418 is used for generating the reference signals, e.g., REF1 and REF2. In one embodiment, the reference signal REF1 can be a reference voltage indicative of a target current for each of the LED strings 302, 304 and 306, as mentioned above. The reference signal REF2 can be a predetermined voltage for determining the output current IOUT for satisfying the current requirement of the LED array 330. In one embodiment, the reference signal REF2 can be a threshold voltage of an LED string which requires the maximum current or forward voltage among the LED strings 302, 304 and 306.

The oscillator 428 is coupled to the current distribution controller 320 and is operable for generating saw-tooth signal(s) for the current distribution controller 320. The switch 458 is coupled to the transformer 464 and used as a power switch for the transformer 464. The snubber circuit 462 can be used to suppress the overshoot on the drain of the switch 458, which can be caused by leakage inductance of the transformer 464 during switching. In one embodiment, the DC voltage from the power supply 360 is converted via the snubber circuit 462 and the transformer 464 to generate the output current IOUT for the LED array 330.

The error signals COMP1, COMP2 and COMP3 output from the current distribution controller 320 are fed back to the feedback selection circuit 408. In one embodiment, the error signals COMP1, COMP2 and COMP3 can indicate the status of the LED currents flowing through the LED strings 302, 304 and 306 respectively. The selected maximum error signal can indicate the current of an LED string which requires the maximum current or forward voltage. Advantageously, as long as the current of the LED string requiring the maximum current or forward voltage is satisfied, currents of other LED strings can be satisfied, in one embodiment. To this end, the selected maximum error signal and the reference signal REF2 are sent to the error amplifier 438, in one embodiment. An error signal VCOMP output from the error amplifier 438 can indicate whether the output current IOUT from the converter 310 is at a proper or desired level.

The error signal VCOMP output from the error amplifier 438 is further sent to a positive input of the comparator 448, in one embodiment. The saw-tooth signal generated by the oscillator 428 and a current signal sensed at the resistor 456 are summed by the current adder 466 to generate an internal ramp signal, in one embodiment. The internal ramp signal is sent to a negative input of the comparator 448. The internal ramp signal can be compared with the error signal VCOMP by the comparator 448 to generate a control signal, e.g., a PWM signal. The control signal is coupled to a reset pin of the RS flip-flop 454 for controlling the switch 458. The duty cycle of the PWM signal generated by the comparator 448 can be adjusted according to a comparison result of the internal ramp signal and the error signal VCOMP. As such, the total current IOUT for the LED array 330 can be regulated.

Figure 5:
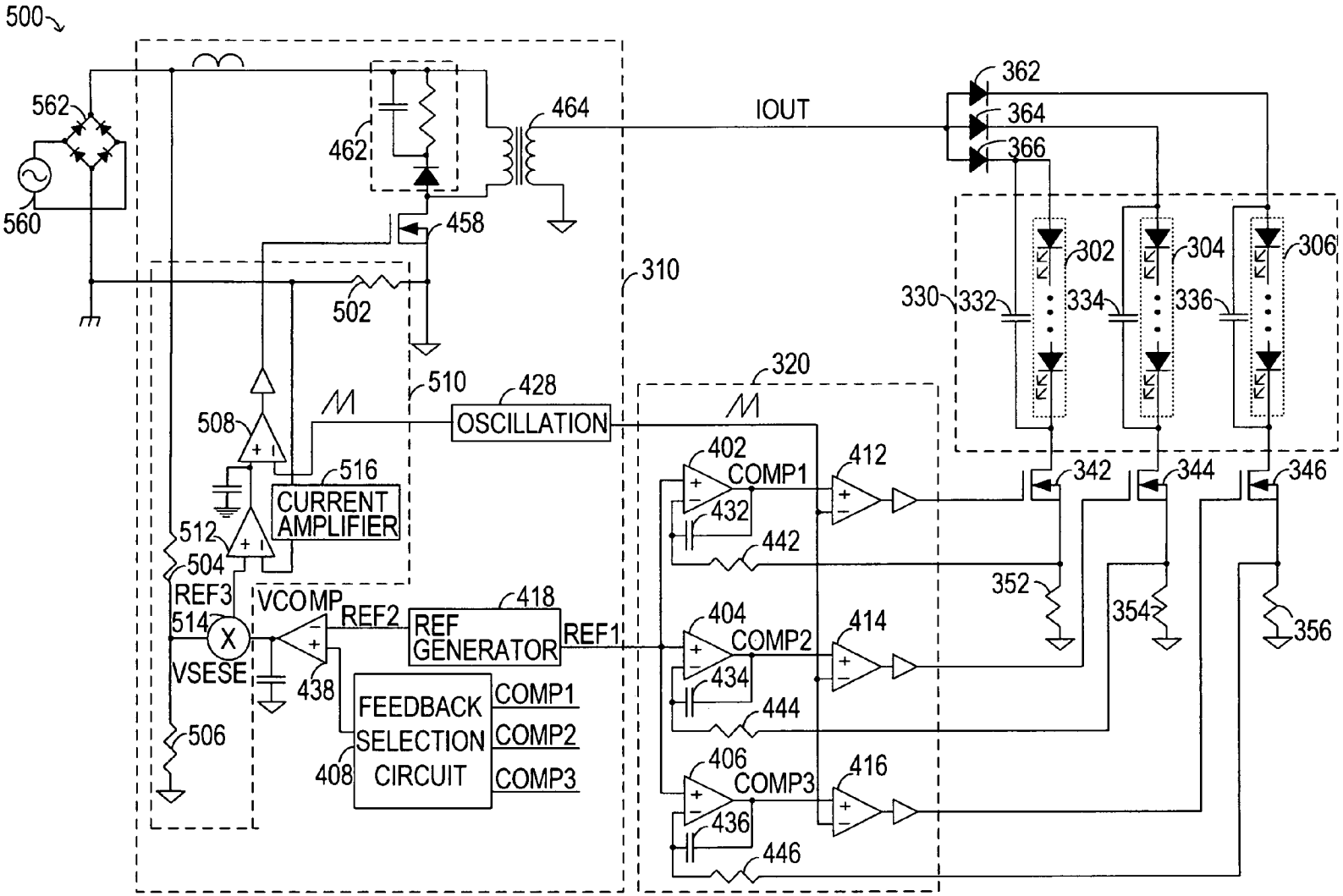
FIG. 5 shows a block diagram of a circuit 500 for controlling and powering light sources, in accordance with still another embodiment of the present invention.

FIG. 5 shows a block diagram of an exemplary circuit 500 for controlling and powering LEDs, in accordance with another embodiment of the present invention. The circuit 500 is another example for the circuit 300. Elements in FIG. 5 labeled the same in FIG. 3 and FIG. 4 have similar functions.

The circuit 500 can be applied if an alternating current (AC) voltage is supplied by a power supply 560. The power supply 560 can be coupled to the converter 310 through a bridge rectifier 562. The bridge rectifier 562 is used for rectifying the AC voltage to an output voltage with the same polarity. In this instance, the converter 310 can be an AC/DC converter. The AC voltage can be converted to the DC output current IOUT by the snubber circuit 462 and the transformer 464. The switch 458 is coupled to the snubber circuit 462 and the transformer 464 and controlled by a control signal for regulating the output current IOUT. In one embodiment, the switch 458 can be further controlled for correcting a power factor of the converter 310, such that the input current can be proportional to the input voltage, improving the power efficiency.

In the example of circuit 500, the converter 310 includes a power factor correction circuit 510 which further includes a voltage multiplier 514, an error amplifier 512, a comparator 508 and a current amplifier 516. The error amplifier 512 is used to generate an error signal ICOMP to control the gate of the switch 458 which is used as a power switch for the transformer 464. The positive input of the error amplifier 512 receives a reference signal REF3 which is proportional to both voltage signals VSENS and VCOMP, in one embodiment. The voltage signal VSENS obtained from the bridge rectifier 562 through resistors 504 and 506 is proportional to the amplitude of the rectified AC power line voltage. The voltage signal VCOMP is output from the error amplifier 438. By the voltage multiplier 514, the voltage signal VSENS is multiplied with the voltage signal VCOMP for providing the reference signal REF3 to the positive input of the error amplifier 512. The negative input of the error amplifier 512 receives a voltage signal which is proportional to the current flowing through a sense resistor 502 via the current amplifier 516, in one embodiment. The current amplifier 516 amplifies the amplitude of the sensed input current from the sense resistor 502, and sends the amplified signal to the negative input of the error amplifier 512.

The output signal ICOMP of the error amplifier 512 can be compared with a saw-tooth signal to generate a PWM signal for controlling the switch 458 to be turned on/off. In one embodiment, if the negative input of the error amplifier 512 is less than the positive input, the output signal ICOMP can rise to increase the duty cycle of the PWM signal. Otherwise, the output signal ICOMP can drop to decrease the duty cycle of the PWM signal. As such, the current input from the bridge rectifier 562 can be regulated to be proportional to both VSENS and VCOMP. Since the input current is proportional to the VCOMP, the output current IOUT is regulated accordingly. In addition, since the input current is proportional to the VSENS, the power factor of the converter 310 can be improved, in one embodiment.

Figure 6:
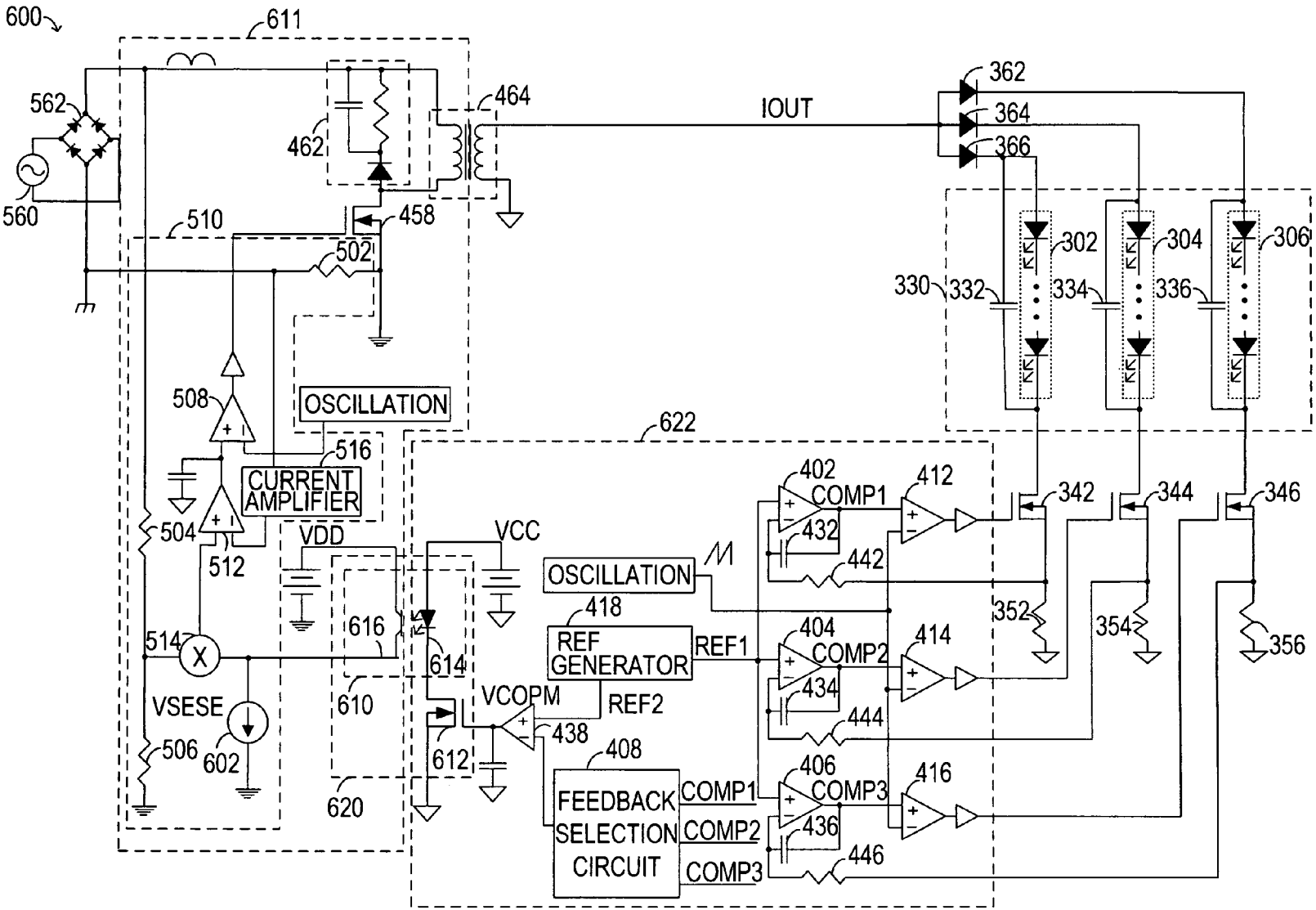
FIG. 6 shows a block diagram of a circuit 600 for controlling and powering LEDs, in accordance with another embodiment of the present invention.

FIG. 6 shows a block diagram of a circuit 600 for controlling and powering LEDs, in accordance with still another embodiment of the present invention. The circuit 600 is still another example for the circuit 300. Elements in FIG. 6 labeled the same in FIG. 3, FIG. 4, and FIG. 5 have similar functions.

The circuit 600 includes a converter 611, a current distribution controller 622 and an isolation circuit 620. The isolation circuit 620 can be coupled between the converter 611 and the current distribution controller 622. The isolation circuit 620 can transfer current signals between two isolated circuit, e.g., the converter 611 and the current distribution controller 622. The isolation circuit 620 includes an opto-coupler 610 and a control switch, such as a transistor 612, in one embodiment. The opto-coupler 610 is an isolated current-current transfer device. The input current of the opto-coupler 610 at an input pin 614 is controlled by VCOMP through the transistor 612. The higher the voltage VCOMP is, the more current can flow into the input pin 614 of the opto-coupler 610. The more current flows into the opto-coupler 610, the more current can flow out from an output pin 616 of the opto-coupler 610. The input of the multiplier 514 can vary in accordance with the output current from the opto-coupler 610 and the current of a current source 602. Accordingly, the output signal ICOMP of the error amplifier 512 can vary so as to control the switch 458 as described hereinabove.

Figure 7:
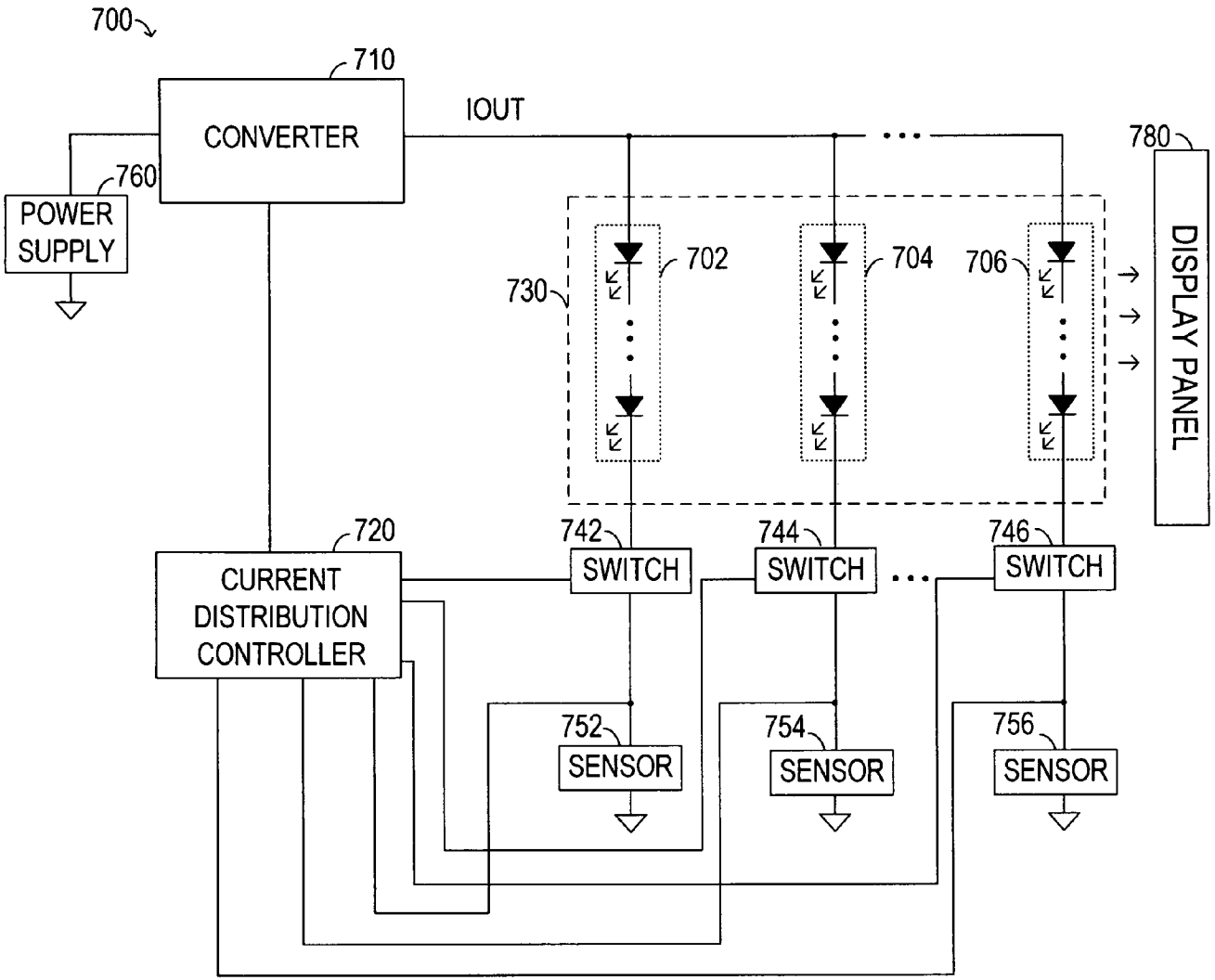
FIG. 7 shows a block diagram of a display system 700 for providing backlight illumination for a display panel, in accordance with one embodiment of the present invention.

FIG. 7 illustrates a block diagram of a display system 700, in accordance with one embodiment of the present invention. In the example of FIG. 7, the display system 700 includes a power supply 760, a converter 710, a current distribution controller 720, an LED array 730, and a display panel 780. The LED array 730 can be operable for illuminating the display panel 780, e.g., a liquid crystal display (LCD) panel, in one embodiment. The LED array 730 can include any number of LED strings coupled in parallel, such as three LED strings 702, 704 and 706 as shown in the example of FIG. 7. Each of the LED strings 702, 704 and 706 can include any number of serially coupled LEDs.

The converter 710 can be coupled to the power supply 760 for converting an input voltage from the power supply 760 to an output current IOUT. The converter 710 can be, but is not limited to, a DC/DC converter or an alternating current to direct current (AC/DC) converter to accommodate various types of power supplies. The output current IOUT is supplied to the LED array 730. As such, the converter 710 serves as a current source for supplying the output current IOUT to the LED array 730, in one embodiment. Furthermore, the converter 710 can regulate the output current IOUT for satisfying the current requirement of the LED array 730, in one embodiment.

The current distribution controller 720 can also be coupled to the LED array 730 for regulating LED currents flowing through the LED strings 702, 704 and 706 respectively. The circuit 700 further includes switches 742, 744 and 746, and sensors 752, 754 and 756. The sensors 752, 754 and 756 can generate feedback signals indicative of LED currents flowing through the LED strings 702, 704 and 706 respectively. The current distribution controller 720 is coupled to the sensors 752, 754 and 756 for generating control signals based on the feedback signals to regulate the LED currents respectively. The current distribution controller 720 can also control the converter 710 to regulate the output current IOUT based on the feedback signals.

Figure 8:
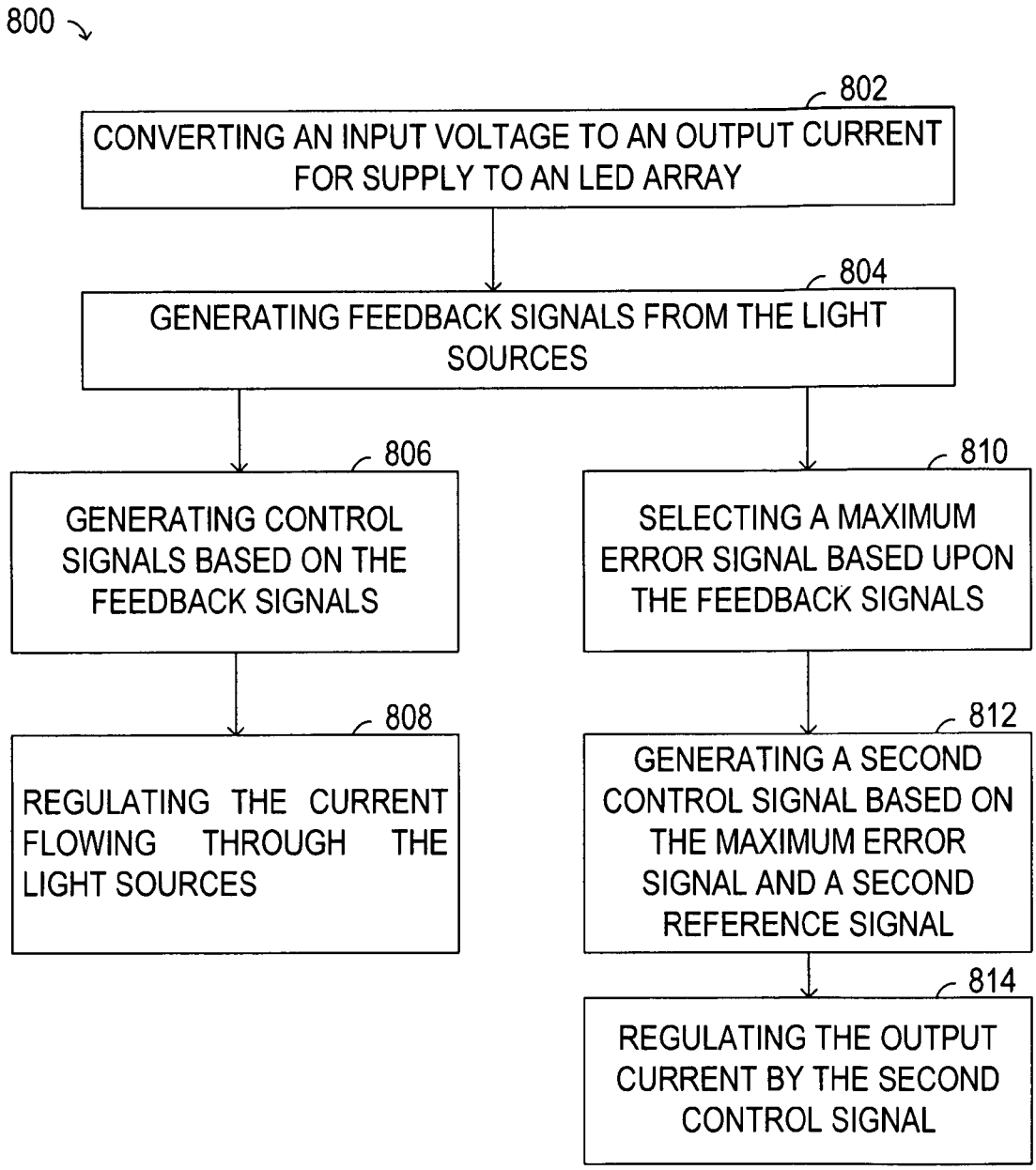
FIG. 8 shows a flowchart of a method 800 for controlling and powering light sources, in accordance with one embodiment of the present invention.

FIG. 8 shows a flowchart 800 of a method for controlling light sources, in accordance with one embodiment of the present invention. The operations shown in the example of FIG. 8 can be performed by a light source driving circuit, e.g., the circuit 400 in FIG. 4. The circuit 400 includes a converter 310, a current distribution controller 320, an LED array 330, and a power supply 260. FIG. 8 is described in combination with FIG. 4.

At 802, an input voltage is converted to an output current which is supplied to the light sources. For example, the converter 310 converts an input voltage to an output current which is supplied to the light sources, e.g., the LED array 330. The converter 310 can include a snubber circuit 462 which is used to suppress the overshoot on the drain of a transistor 458, which can be caused by leakage inductance of a transformer 464 during switching. An input voltage from the power supply 360 is converted via the snubber circuit 462 and the transformer 464 to output an output current IOUT for the LED array 330.

At 804, feedback signals can be generated by a feedback circuit. For example, feedback signals generated by a feedback circuit, e.g., by sense resistors 352, 354 and 356, can be fed back to the current distribution controller 320. The feedback signals can indicate and can be proportional to the currents flowing through the LED strings 302, 304 and 306 respectively.

At 806, control signals can be generated based on the feedback signals. For example, based upon the feedback signals sensed at each of sense resistors 352, 354 and 356 and a first reference signal REF1, the control signals, e.g., PWM signals, can be generated. More specifically, error signals COMP1-COMP3 can be generated by comparing the feedback signals with the reference signal REF1. The reference signal REF1 can indicate a target current flowing through each string of the LED array 330. The control signals, e.g., the PWM signals, can be generated by comparing the error signals COMP1-COMP3 with a saw-tooth signal.

At 808, the current flowing through the light sources can be regulated. For example, the duty cycles of the PWM signals can be adjusted for controlling the transistors 342, 344 and 366. The durations when the transistors 342, 344 and 366 are turned on are controlled by the duty cycles of the PWM signals respectively, such that the current flowing through each string of the LED array 330 can be regulated.

At 810, a maximum error signal can be selected. For example, the error signals COMP1, COMP2, COMP3 indicating the currents flowing through the LED strings 302, 304 or 306 respectively are fed back to the converter 310. A maximum error signal of the error signals COMP1, COMP2, COMP3 can be selected to input to an error amplifier 438.

At 812, a second control signal can be generated. For example, a control signal, e.g., a PWM signal, can be generated by comparing the selected maximum error signal with a second reference signal REF2. More specifically, an error signal can be generated by comparing the selected maximum error signal with the second reference signal REF2. The reference signal REF2 can indicate a predetermined voltage according to which the output current IOUT is regulated to satisfy the current requirement of the LED strings. Thus, the control signal, e.g., a PWM signal, can be generated by comparing the error signal with a saw-tooth signal.

At 814, the second control signal can be used to regulate the output current of the converter. For example, the duty cycle of the PWM signal can be adjusted for controlling a switch, e.g., a transistor 458, to be turned on/off. The transistor 458 coupled to the transformer 464 is used as a power switch for the transformer 464. In one embodiment, when the transistor 458 is turned off, the output current IOUT output from the transformer 464 is reduced. In one embodiment, when the transistor 458 is turned on, the current IOUT is increased. As such, the output current IOUT for the LED array 330 can be regulated based on the feedback signals.

While the foregoing description and drawings represent embodiments of the present invention, it will be understood that various additions, modifications and substitutions may be made therein without departing from the spirit and scope of the principles of the present invention as defined in the accompanying claims. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims and their legal equivalents, and not limited to the foregoing description.

What is claimed is:

1. A circuit for controlling a plurality of light emitting diode (LED) light sources, said circuit comprising:

a converter operable for converting an input voltage to an output current and for providing said output current to said LED light sources;

a feedback circuit coupled to said LED light sources and operable for generating a plurality of feedback signals indicative of a plurality of LED currents flowing through said LED light sources respectively;

a current distribution controller coupled to said feedback circuit and operable for generating a plurality of control signals based on said feedback signals respectively so as to regulate said LED currents flowing through said LED light sources respectively, and also operable for controlling said converter to regulate said output current based on said feedback signals;

a plurality of diodes, each of said diodes coupled between said converter and a corresponding LED light source of said LED light sources;

a transformer operable for receiving a rectified AC voltage and for providing said output current to said LED light sources;

a power switch coupled to said transformer and operable for regulating said output current; and an error amplifier operable for generating a first error signal to control said power switch, wherein a positive input of said error amplifier receives a first reference signal which is proportional to both a first voltage signal and a second voltage signal, wherein a negative input of said error amplifier receives a third voltage signal, wherein said first voltage signal is proportional to said rectified AC voltage, wherein said second voltage signal indicates said output current from said converter, and wherein said third voltage signal is proportional to a current flowing through a sense resistor coupled to said power switch.

2. The circuit as claimed in claim 1, further comprising:

a plurality of switches controlled by said control signals to regulate said currents respectively in a switching mode.

3. The circuit as claimed in claim 1, wherein said control signals comprise pulse width modulation (PWM) signals.

4. The circuit as claimed in claim 1, further comprising:

a plurality of error amplifiers operable for comparing said feedback signals with a second reference signal to generate a plurality of error signals respectively; and a plurality of comparators coupled to said error amplifiers and operable for comparing said error signals with a first saw-tooth signal to generate said control signals respectively.

5. The circuit as claimed in claim 4, wherein said second reference signal indicates a target current flowing through at least one of said LED light sources.

6. The circuit as claimed in claim 4, further comprising:

a selection circuit coupled to said error amplifiers and operable for selecting a maximum error signal from said error signals;

a second error amplifier coupled to said selection circuit and operable for comparing said maximum error signal with a third reference signal to generate a second error signal; and a comparator coupled to said second error amplifier and operable for comparing said second error signal with a second saw-tooth signal to generate a second control signal for regulating said output current.

7. The circuit as claimed in claim 6, wherein said third reference signal indicates a predetermined voltage according to which said output current is regulated for satisfying the current requirement of said LED light sources.

8. The circuit as claimed in claim 1, further comprising:

a power factor correction circuit coupled to said converter and operable for controlling an input current of said converter proportional to said input voltage of said converter.

9. The circuit as claimed in claim 1, further comprising:

an isolation circuit operable for transferring a plurality of current signals between said converter and said current distribution controller.

10. A method for controlling a plurality of LED light sources coupled in parallel, said method comprising:

converting an input voltage to an output current;

providing said output current to said LED light sources through a plurality of diodes, each of said diodes coupled to a respective LED light source of said LED light sources;

generating a plurality of feedback signals indicative of a plurality of currents flowing through said LED light sources respectively;

generating a plurality of control signals based on said feedback signals respectively for regulating said current of said LED light sources respectively; and generating a first error signal based on a first reference signal and a first voltage signal to control a power switch coupled to a transformer to regulate said output current based on said feedback signals, wherein said first reference signal is proportional to both a second voltage signal and a third voltage signal, wherein said second voltage signal is proportional to a rectified AC voltage, wherein said third voltage signal indicates said output current, and wherein said first voltage signal is proportional to a current flowing through a sense resistor coupled to said power switch.

11. The method as claimed in claim 10, further comprising:

controlling a plurality of switches coupled to said LED light sources respectively in a switching mode; and regulating said currents by said switches.

12. The method as claimed in claim 10, further comprising:

generating a plurality of pulse width modulation (PWM) signals based upon said feedback signals; and controlling said LED light sources by said PWM signals respectively.

13. The method as claimed in claim 10, further comprising:

generating a plurality of error signals by comparing said feedback signals with a second reference signal; and generating said control signals by comparing said error signals with a first saw-tooth signal.

14. The method as claimed in claim 13, wherein said second reference signal indicates a target current flowing through at least one of said LED light sources.

15. The method as claimed in claim 13, further comprising:

selecting a maximum error signal from said error signals;

generating a second error signal by comparing said maximum error signal with a third reference signal;

generating a second control signal by comparing said second error signal with a second saw-tooth signal; and regulating said output current by said second control signal.

16. The method as claimed in claim 15, wherein said third reference signal indicates a predetermined voltage according to which said output current is regulated for satisfying the current requirement of said LED light sources.

17. A system comprising:

a display panel;

a plurality of light-emitting diode (LED) strings coupled in parallel that illuminate said display panel;

a converter coupled to said LED strings that converts an input voltage to an output current and that provides said output current to said LED strings;

a plurality of sensors that generate a plurality of feedback signals indicative of a plurality of LED currents flowing through said LED strings respectively; and a current distribution controller coupled to said sensors that generates a plurality of control signals based on said feedback signals respectively to regulate said LED currents respectively, and that controls said converter to regulate said output current based on said feedback signals;

a plurality of diodes, each of said diodes coupled between said converter and a corresponding LED string of said LED strings;

a transformer that receives a rectified AC voltage and that provides said output current to said LED light sources;

a power switch coupled to said transformer and that regulates said output current; and an error amplifier that generates a first error signal to control said power switch, wherein a positive input of said error amplifier receives a first reference signal which is proportional to both a first voltage signal and a second voltage signal, wherein a negative input of said error amplifier receives a third voltage signal, wherein said first voltage signal is proportional to said rectified AC voltage, wherein said second voltage signal indicates said output current from said converter, and wherein said third voltage signal is proportional to a current flowing through a sense resistor coupled to said power switch.

18. The system as claimed in claim 17, further comprising:

a plurality of error amplifiers that compare said feedback signals with a second reference signal to generate a plurality of error signals respectively; and a plurality of comparators coupled to said error amplifiers that compare said error signals with a saw-tooth signal to generate said control signals respectively.

19. The system as claimed in claim 18, wherein said second reference signal indicates a target current flowing through at least one of said LED strings.

* * * * *